US011788411B2

(12) United States Patent
Board

(10) Patent No.: US 11,788,411 B2
(45) Date of Patent: Oct. 17, 2023

(54) SYSTEMS AND METHODS OF UNDERHAND CLOSED BENCH MINING

(71) Applicant: Hecla Mining Company, Coeur d'Alene, ID (US)

(72) Inventor: Mark Board, Coeur d'Alene, ID (US)

(73) Assignee: HECLA MINING COMPANY, Coeur d'Alene, ID (US)

( * ) Notice: Subject to any disclaimer, the term of this patent is extended or adjusted under 35 U.S.C. 154(b) by 76 days.

(21) Appl. No.: 17/507,923

(22) Filed: Oct. 22, 2021

(65) Prior Publication Data

US 2023/0126105 A1 Apr. 27, 2023

(51) Int. Cl.
*E21C 41/22* (2006.01)

(52) U.S. Cl.
CPC ..... *E21C 41/22* (2013.01)

(58) Field of Classification Search
CPC ..... E21C 41/22
See application file for complete search history.

(56) References Cited

PUBLICATIONS

SME_MXC23_Technical Program2_2023 accessed from https://www.smeannualconference.com/index.cfm/conference/program/technical-sessions-2023/ (Year: 2023).*
My first time really underground—The Lucky Friday Mine | Shoshone News-Press accessed from shoshonenewspress.com Feb. 2023 (Year: 2021).*
Technical Report Summary on the Lucky Friday Mine, Idaho, USA SLR Project No. 101.00632.00022 accessed from Hecla.com Feb. 2023 (Year: 2022).*

* cited by examiner

*Primary Examiner* — Janine M Kreck
(74) *Attorney, Agent, or Firm* — K&L Gates LLP

(57) ABSTRACT

The present invention relates to systems and methods of mining, including drilling a first plurality of blast holes along a length of a horizontal stope and blasting explosive within the first plurality of blast holes. The method includes recovering fragmented ore from the horizontal stope and stabilizing the horizontal stope via a first engineered roof. The method then includes drilling a second plurality of blast holes along the length of the horizontal stope and blasting explosive within the second plurality of blast holes. The method further includes recovering fragmented ore from the horizontal stope and stabilizing the horizontal stope via a second engineered roof. The horizontal stope is mined in a downward direction.

18 Claims, 6 Drawing Sheets

SYSTEMS AND METHODS OF UNDERHAND CLOSED BENCH MINING

FIELD OF THE INVENTION

The invention disclosed herein generally relates to systems and methods for blasting and mining in deep narrow vein mines, particularly progressing in an overall downward direction.

BACKGROUND

There are two common forms of mining to obtain rocks, minerals, and other desirable resources from the earth: surface mining and underground mining. Surface mines typically involve an open pit; the rocks, minerals, and other resources are extracted from this open pit and subsequently sorted from undesirable, non-mineral waste materials by crushing and milling. Underground mines, by comparison, typically involve a deep shaft and elevator (including both personnel cages and ore skips), which provide access to mineralized orebodies below ground level (e.g., up to a mile or more below ground level). Miners access these areas from the shaft and extract material, typically by drilling and blasting, from the sub-surface environment. Once removed, the material is hoisted to the surface for milling and extraction of the particular resource.

Specifically, deep, underground mining of vertically-dipping, narrow veins of precious metals, such as gold and silver (often found with base metals), typically involves drilling and blasting methods that utilize overall vertically-advancing extraction of an individual vein. For example, a vein may be a long and narrow crack (e.g., 10 feet wide, 2,000 feet long, and many thousand feet in depth), filled with desirable ore. Access to the veins is accomplished via vertical shafts or declining tunnels excavated in the unmineralized host rock. These access points are then used to transport personnel and materials to mining locations underground, and to transport ore minerals and waste rock material to the surface where it is milled to separate valuable minerals from waste material.

With respect to vertically-dipping, narrow vein mining, two common methods are cut and fill mining and longhole mining. Both of these methods involve excavation of horizontal access tunnels from the vertical shafts or ramp tunnels, from which the vein is accessed at regular vertical intervals. Individual blocks of ore on the vein, typically 150 to 300 feet in vertical height are identified by exploration drilling; these individual blocks are subsequently mined along the length of the mineable vein. Mining in each of these blocks starts at the lowest access point and progresses vertically upward through the block until it reaches the above, previously-mined block. This is typically termed "overhand" cut and fill mining as the vein is mined from the bottom up.

With "underhand" cut and fill mining, the block is mined via a series of horizontal cuts advanced by small face blasts (e.g., in a horizontal direction), typically nine to twelve feet in height, that result in bottom-slicing the vein (i.e., the vein is mined from the top down). When a horizontal cut is completed, it is backfilled with finely-ground mill waste tailings mixed with cement. Once filled and strength is gained (usually a few days), the next cut is mined in the same fashion beneath the backfill which acts as an engineered roof.

With longhole mining, the block is extracted from the bottom up (also generally referred to as overhand) in a series of larger slices, usually about fifty feet in height at a time (as opposed to the typical 10 feet cut and fill slice). An upper and lower tunnel are first driven along the strike of the vein. The upper tunnel is used as a horizon to drill vertical, downward-oriented blast holes, whereas the lower tunnel is used to provide expansion room for the blasted slice as the fragmented ore drops by gravity after blasting. The blasted rock is then collected, using front-end loaders, from this lower tunnel.

With both cut and fill and longhole methods, the void created by the excavated vein is backfilled with finely-crushed, cemented waste material, from the mill; once backfilled, the mining front advances upward (in longhole) or downward (in underhand cut and fill) for the next slice to be blasted.

That said, the primary issue with these mining methods, particularly in deep vein mining with depths exceeding 3,000 feet, is that the methods typically require vertical advance on several mining levels (to create sufficient production); this creates pillars trapped between mined voids. At great depths, the ground stresses are extremely high and are concentrated in these pillars. Concentrated stresses may exceed the rock strength at an individual pillar, resulting in mining-induced seismic events, up to about 3.0 on the Richter scale. These seismic events can create significant damage to excavations, affecting production schedules. Seismic events are all the more concerning when they are occurring near the excavation where mining personnel are working, as tunnel collapse can occur and is extremely dangerous to mining personnel.

Therefore, for at least these reasons, a need exists for improved systems and methods for blasting and mining in deep narrow veins by providing controlled seismic activity in a desired time and location, thus improving personnel safety and reducing or eliminating damage to excavations induced by the seismic vibrations.

SUMMARY

The present invention is generally directed toward new systems and methods for mining, by employing a newly developed "underhand closed bench technique." Namely, underhand closed bench mining was developed specifically to improve control of seismic activity in deep narrow-vein mining while simultaneously providing added safety and productivity benefits.

Specifically, via the underhand closed bench technique, mining is performed in a downward direction, progressing through the vertical or near-vertical veins, slice-by-slice, in a downward fashion. Via the underhand closed bench technique, blasting proactively triggers fault-slip seismicity at the desired time of choosing by the mine operators (e.g., when personnel are restricted from the affected area). This technique was developed specifically for improving the safety of mining personnel operating in seismically-active rock masses. As an added benefit, this technique yields increases in both production and predictability over standard cut and fill mining methods. Further, the underhand closed bench technique ensures that subsequent slices are mined underneath an engineered roof from a previous slice. In embodiments, this engineered roof includes cemented and reinforced backfill. The roof provides a much safer work environment for mining personnel.

Whereas, in the underhand cut and fill method, the mining slice is excavated incrementally along the vein in a horizontal direction using a series of small (8 foot long) blasts, the underhand closed bench technique herein uses large diameter (e.g., 3.5 inch) blast holes drilled vertically into the vein from the floor of the excavation. The fragmented ore from the blast is directed both laterally and upward into the existing excavation while the stress wave from the blast itself is directed in all directions into the surrounding rock mass. This directional configuration, coupled with particular blast sizes and patterns discussed herein, will proactively trigger seismic events (e.g., due to unstable slip on faults beneath the mining floor). By proactively triggering seismic events on faults located near the mining, any slip and accompanying seismic energy release occurs during blasting, at a pre-determined time when no mining personnel are present; moreover, the fault slip occurs in the vicinity of the slice being mined; in other words, the radiating blast wave seeks out those faults that may be critically loaded and triggers seismic events that may otherwise occur at an unknown time and location.

In light of the disclosure herein, and without limiting the scope of the invention in any way, in a first aspect of the present disclosure, which may be combined with any other aspect listed herein unless specified otherwise, a method of mining includes drilling a first plurality of blast holes along a length of a horizontal stope. The method includes blasting explosive within the first plurality of blast holes. The method includes recovering fragmented ore from the horizontal stope. The method includes stabilizing the horizontal stope via a first engineered roof. The method includes drilling a second plurality of blast holes along the length of the horizontal stope. The method includes blasting explosive within the second plurality of blast holes. The method includes recovering fragmented ore from the horizontal stope. The method includes stabilizing the horizontal stope via a second engineered roof, such that the horizontal stope is mined in a downward direction.

In a second aspect of the present disclosure, which may be combined with any other aspect listed herein unless specified otherwise, each of the first plurality of blast holes and the second plurality of blast holes are disposed on a floor of the horizontal stope.

In a third aspect of the present disclosure, which may be combined with any other aspect listed herein unless specified otherwise, the first engineered roof includes backfill material.

In a fourth aspect of the present disclosure, which may be combined with any other aspect listed herein unless specified otherwise, the explosive is sufficient to cause a seismic event in the downward direction.

In a fifth aspect of the present disclosure, which may be combined with any other aspect listed herein unless specified otherwise, the first plurality of blast holes and the second plurality of blast holes are injected with pumpable emulsion explosives.

In a sixth aspect of the present disclosure, which may be combined with any other aspect listed herein unless specified otherwise, the first plurality of blast holes are patterned in a square configuration.

In a seventh aspect of the present disclosure, which may be combined with any other aspect listed herein unless specified otherwise, the square configuration includes nine blast holes and eight dead holes.

In an eighth aspect of the present disclosure, which may be combined with any other aspect listed herein unless specified otherwise, the length of the horizontal stope is fragmented in one simultaneous blast.

In a ninth aspect of the present disclosure, which may be combined with any other aspect listed herein unless specified otherwise, the length of the horizontal stope is approximately three hundred feet.

In a tenth aspect of the present disclosure, which may be combined with any other aspect listed herein unless specified otherwise, a method of mining includes drilling a first plurality of blast holes along a length of a horizontal stope. At least one slip-on fault is disposed under the horizontal stope. The method includes blasting explosive within the first plurality of blast holes. The method includes recovering fragmented ore from the horizontal stope. The method includes drilling a second plurality of blast holes along the length of the horizontal stope. The method includes blasting explosive within the second plurality of blast holes. The method includes recovering fragmented ore from the horizontal stope, such that the horizontal stope is mined in a downward direction.

In an eleventh aspect of the present disclosure, which may be combined with any other aspect listed herein unless specified otherwise, each of the first plurality of blast holes and the second plurality of blast holes are disposed on a floor of the horizontal stope.

In a twelfth aspect of the present disclosure, which may be combined with any other aspect listed herein unless specified otherwise, the first plurality of blast holes are drilled at a first starting depth, the second plurality of blast holes are drilled at a second starting depth, and the first starting depth is at least twenty feet above the second starting depth.

In a thirteenth aspect of the present disclosure, which may be combined with any other aspect listed herein unless specified otherwise, the explosive is sufficient to cause a seismic event at the slip-on fault.

In a fourteenth aspect of the present disclosure, which may be combined with any other aspect listed herein unless specified otherwise, the first plurality of blast holes and the second plurality of blast holes are injected with pumpable emulsion explosives.

In a fifteenth aspect of the present disclosure, which may be combined with any other aspect listed herein unless specified otherwise, the first plurality of blast holes are patterned in a square configuration.

In a sixteenth aspect of the present disclosure, which may be combined with any other aspect listed herein unless specified otherwise, the square configuration includes nine blast holes and eight dead holes.

In a seventeenth aspect of the present disclosure, which may be combined with any other aspect listed herein unless specified otherwise, the length of the horizontal stope is fragmented in one simultaneous blast.

In an eighteenth aspect of the present disclosure, which may be combined with any other aspect listed herein unless specified otherwise, the length of the horizontal stope is approximately three hundred feet.

In a nineteenth aspect of the present disclosure, which may be combined with any other aspect listed herein unless specified otherwise, a depth of the first plurality of blast holes is approximately 26 feet deep.

In a twentieth aspect of the present disclosure, which may be combined with any other aspect listed herein unless specified otherwise, the first plurality of blast holes includes a burn cut and a plurality of patterned blast hole rings.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

It should be understood at the outset that, although illustrative implementations of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Figure 1:
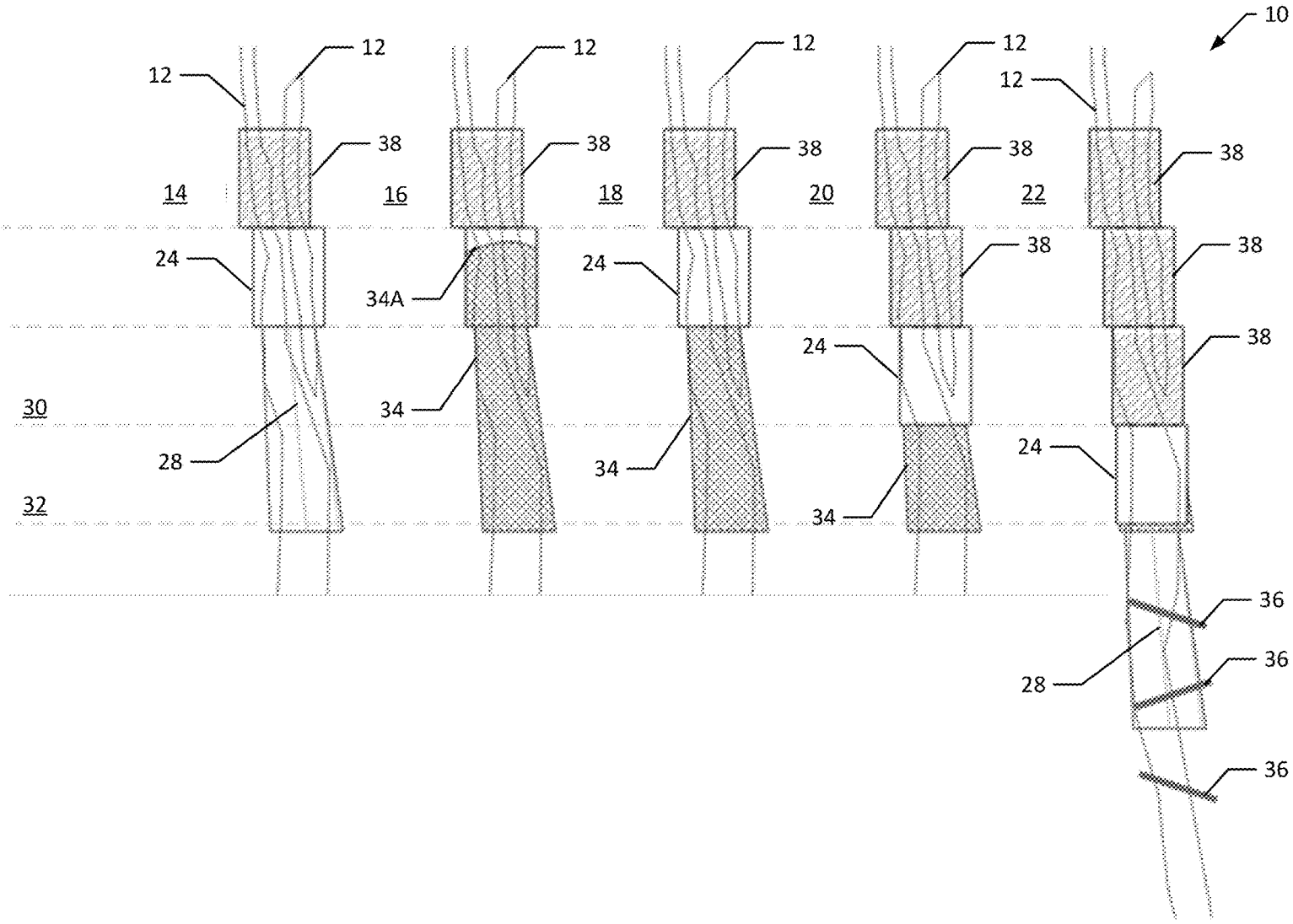
FIG. 1 illustrates a cross-section view of a method of underhand closed bench mining on a vertical vein, according to an example embodiment of the present disclosure.

FIG. 1 illustrates a cross-section view of a method 10 of underhand closed bench mining on a vertical vein 12. As illustrated, the method 10 is depicted as five separate steps. Generally, first step 14 includes drilling a target section for blasting. Second step 16 includes blasting drill holes in the target section. Third step 18 includes mucking out swell, preparing the stope, and backfilling. Fourth step 20 includes advancing mining underhand for a first cut. Fifth step 22 includes advancing mining underhand for a second cut. With this initial summary in mind, each of these five steps 14, 16, 18, 20, 22 is described in greater detail herein.

Figure 2:
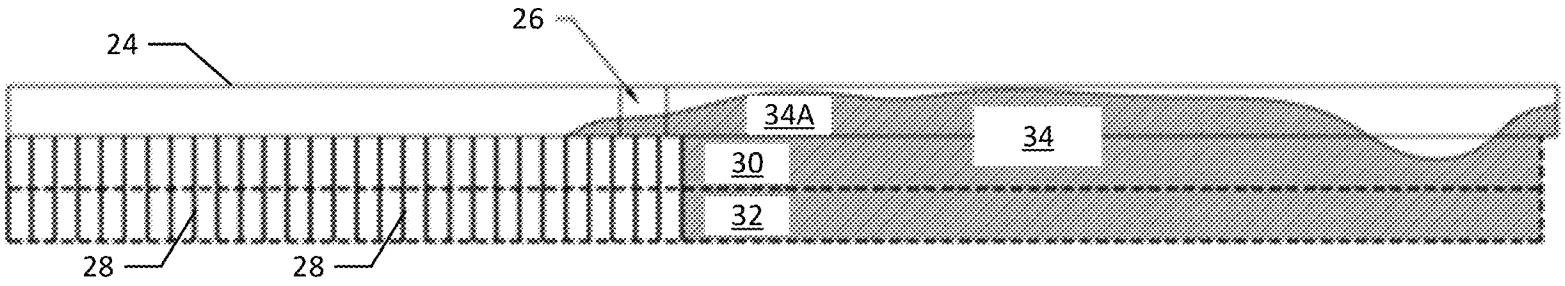
FIG. 2 illustrates an elevation side view of the method in FIG. 1, according to an example embodiment of the present disclosure.

Specifically, with reference to FIGS. 1 and 2, a stope 24 is accessed from a ramp access point or crosscut 26 (e.g., the footwall ramp system at the center of stope 24). As discussed in greater detail herein, this stope 24 (approximately 700 feet in horizontal length) is blasted one half at a time (e.g., one half, from the center of stope 24). Vertical blast holes 28 are drilled downward into the vein of ore. For example, the vertical blast holes 28 are drilled directly into the floor of stope 24. Vertical blast holes are configured to fragment two additional cut heights (e.g., first cut height 30 and second cut height 32). Once blasted, the ore material swells vertically into stope 24, as well as laterally into the drilled void burn holes (discussed in greater detail herein). For example, while the left half of FIG. 2 illustrates a pre-blasted configuration, the right half of FIG. 2 illustrates a post-blasted configuration, including blasted ore 34 swelling vertically into stope 24 as swell 34A.

At the outset, it is worth emphasizing that in addition to the vertical vein 12, the mining environment may include additional geological features including faults 36 cutting through the orebody below the downward advancing stope 24. As noted previously, faults 36 are undesirable, due to the inherent risks associated with slippage.

With that said, returning specifically to method 10, first step 14 illustrates that the vein 12 has already been previously mined and subsequently backfilled. For example, first step 14 illustrates an open stope 24, disposed underneath an engineered roof 38 (e.g., backfilled with engineered cemented paste). This open stope 24 has been mined along the strike of the orebody (e.g., into the page of FIG. 1, and along the length of FIG. 2). In an embodiment, the open stope 24 has a height of 13 feet. Advantageously, this stope height can accommodate a long hole drill. In an embodiment, the open stope 24 is the width of the ore body, such that the width covers the entire width of vein 12. For example, as illustrated in first step 14, the orebody includes several vertically dipping veins 12 embedded within host rock; the number, width, and continuity of veins 12 with vary along the orebody length (e.g., into the page of FIG. 1) and along the orebody depth (e.g., downward from open stope 24).

The floor of stope 24 includes a plurality of vertical blast holes 28 (e.g., drilled via long hole drill) with a series of vertical blast hole rings to a particular depth, such as 26 to 28 feet deep. Vertical blast holes 28 are blasted with emulsion explosive, initiated with programmable electronic detonators. The result of this blast is that fragmented ore 34 swells up into open stope 24 as swell 34A depicted by FIG. 2.

By blasting downward with vertical blast holes 28 along the floor of open stope 24, the blast wave is directed in a generally downward direction. Specifically, with reference to FIG. 3, a fault 40 (similar to the faults 36 depicted in FIG. 1) is depicted below stope 24. It should be appreciated that faults, such as fault 40, can be disposed at various angles and/or locations under stope 24.

Figure 3:
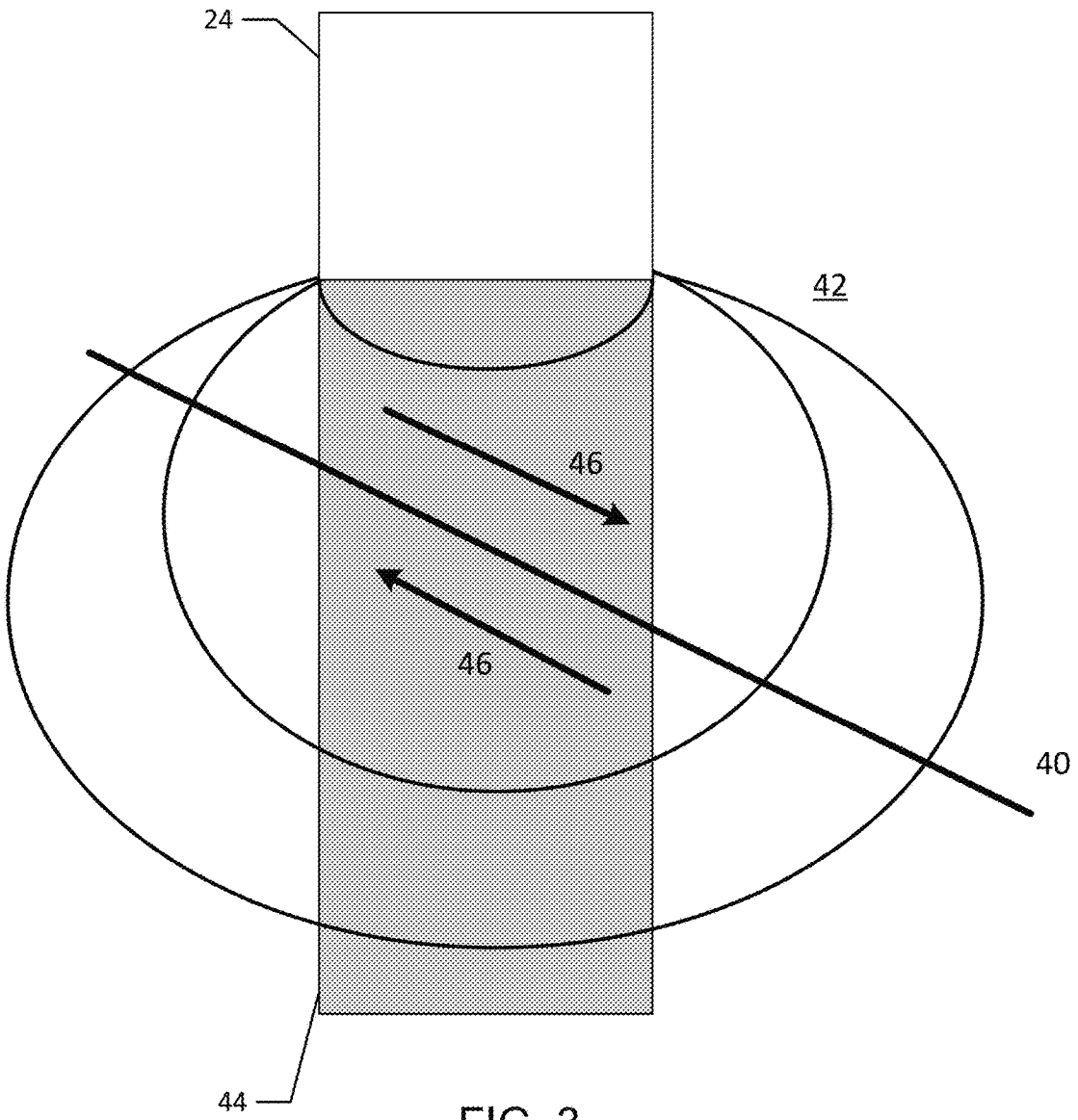
FIG. 3 illustrates a schematic cross-section of an underhand closed bench blasting, depicting induced fault slips.

Upon explosion, blast wave 42 is transmitted through the rock mass, in a downward direction (e.g., from stope 24, through blasted rock and ore body 44). FIG. 3 schematically illustrates the potential presence of a fault 40 cutting through the ore body 44 (and related wall rock) at an angle beneath the stope 24 and related blasted rock. The locations of these faults are generally unknown until they are mined through, thus presenting a seismic hazard. In typical cut and fill mining, unstable slip on these faults can occur at any time as a result of stress redistribution around the small, excavated stope which is slowly and incrementally advanced horizontally beneath the engineered fill as described above. In addition to fragmenting the ore in the floor of the stope 24, the stress wave induced by the blast transmits down through the orebody and surrounding wall rock, causing both stress disruption and deformation on any near-stope fault surface that it encounters. If the fault is critically-stressed (i.e., near to the stress state for rupture), the dynamic disruption to clamping and shear stress-induced by the stress wave will cause slip to occur with subsequent energy release as a seismic event. The large amount of explosive detonated in the blast described herein (e.g., about 25,000 to 35,000 lbs. as opposed to 150 lbs. in typical cut and fill face blast) facilitates triggering of the fault slip 46 at the time of the blast, thus relieving stored energy and allowing resumption of personnel access within a short time thereafter.

Returning to FIG. 1, upon blasting of vertical blast holes 28, second step 16 illustrates that swell 34A (in FIG. 2) of fragmented ore 34 is expanded into open stope 24. Furthermore, fragmented ore 34 extends far below the blast location (e.g., underneath stope 24). The swell 34A within stope 24 is easily extracted to the original floor line of stope 24; for example, a load-haul-dump systems are used to muck up fragmented ore 34 and haul it to a storage bay at a ramp (e.g., three-hundred feet into the footwall rock), where it is subsequently loaded into trucks for transport to ore bins at the mine shaft.

Third step 18 illustrates the stope 24 once all swell 34A has been mucked. For example, after mucking, there are two 13 foot high cuts of fragmented ore beneath the open stope 24, first cut 30 and second cut 32.

Fourth step 20 illustrates that the previously blasted stope 24 is backfilled with an engineered roof 38 (e.g., backfilled with engineered cemented paste), such that first cut 30 is accessed from the footwall crosscut (e.g., by slabbing out the floor and intersecting the ore body). Since the fragmented ore 34 at first cut 30 has already been blasted, load-haul-dump machinery can be used with little to no additional blasting to muck out first cut 30 below engineered roof 38. This mucking will advance along the strike of the ore body (e.g., to the end of the blasted section). As mucking advances, the stope walls are supported with wire mesh and rock bolts.

Fifth step 22 illustrates that first cut 30 is backfilled with an engineered roof 38 (e.g., backfilled with engineered cemented paste) and allowed to cure for approximately three days. Once cured, the remainder of fragmented ore 34 at second cut 32 is mucked, similar to first cut 30 above. At completion of fifth step 22, all of the fragmented ore 34 from the initial explosions at vertical blast holes 28 has been extracted. This results in a solid un-blasted floor at the bottom of open stope 24. At this point, method 10 repeats itself, as new vertical blast holes 28 are drilled into the floor of open stope 24, such that each of five steps 14, 16, 18, 20, 22 are sequentially repeated. For example, method 10 repeats itself for the blasting and extraction of 26 feet deep fragmented ore 34 (e.g., via first cut 30 and second cut 32) in two downward-progressing stope cuts.

In an embodiment, vertical blast holes 28 are drilled through one or more faults 36. In a different embodiment, faults 26 are seismically slipped via a prior explosion (e.g., as illustrated by FIG. 3), such that faults 36 no longer exist by the time that portion of vein 12 is being drilled.

Figure 4:
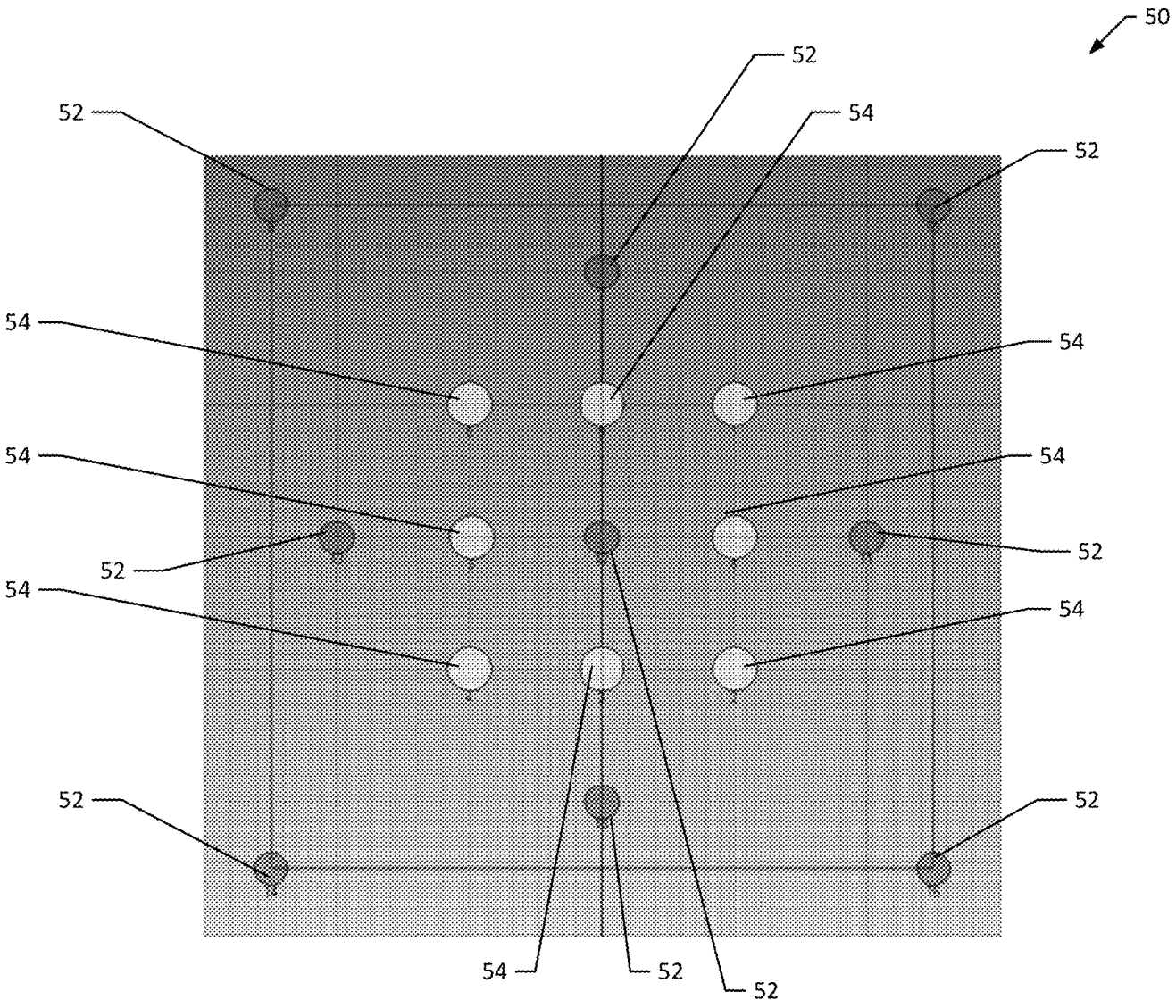
FIG. 4 illustrates an initial burn section of the blast pattern which creates lateral expansion room for the blast for underhand closed bench mining, according to an example embodiment of the present disclosure.

Regarding the drilling of vertical blast holes 28, it should be appreciated that the blast holes 28 can be drilled in a number of different patterns. For example, FIG. 4 illustrates an exemplary burn section blast pattern 50 for initial blasting and void creation of underhand closed bench mining method 10. In an embodiment, the blast holes for the initial burn section are drilled into a square configuration pattern into the floor of stope 24. In a particular embodiment, the square configuration pattern includes nine blast holes, which receive explosive material, and includes eight dead holes, which do not receive explosive material but are instead left empty. While FIG. 4 illustrates a specific burn section blast pattern 50, it should be appreciated that other patterns are contemplated herein, including different geometric orientations of the blast holes and/or dead holes, including different numbers of blast holes and/or dead holes, and the like. The burn section blast pattern 50 provides breaking room for the rest of the subsequent blasting (as previously illustrated and described with respect to method 10 above).

In the embodiment illustrated by FIG. 4, a grouping of vertical blast holes 52 are drilled. For example, blast holes 52 are 3 inch diameter blast holes and are 26 feet long. Similarly, a grouping of vertical dead holes 54 are drilled. For example, dead holes 54 are 4 inch diameter dead holes and are 29 feet long. To achieve fragmentation of the ore during blasting, the ore must have open voids that the blasted rock can displace toward, such as dead holes 54. If no dead holes 54 are present, the rock will be in a confined state and the explosive energy will simply "rifle" straight up out of the hole and fracturing will be confined to a small radius around the blast hole. With underhand closed bench mining, ore is successfully fragmented underneath the open stope, using a confined bench blasting technique. This eliminates the need to drill a small vertical shaft (or raise) at an end of the stope to provide expansion room for the blasted ore to fragment. Namely, given the configuration of the blast pattern 50 for the burn section, coupled with the blasting sequence herein, ore is fragmented without additional expansion room (beyond the stope itself).

This particular orientation illustrated by FIG. 4 is configured to create the initial burn cut at the end of the blast rings, and is located near the stope entry. The dead holes 54 are drilled in a generally square pattern, and are configured to create room for breakage upon detonation of the explosives. The blast holes 52 are loaded with an emulsion to approximately 6 feet of the hole collar. The blast holes 52 may be subsequently stemmed with pea gravel, to the floor's elevation. In an embodiment, this particular blast configuration achieves a powder factor of 1.75 to 2.25 lbs. of explosive per ton of rock. The blast is initiated at the burn cut, which creates an open void, followed by initiating blast hole rings from the burn cut to the end of the stope. The blast hole rings 52 are detonated using programmable electronic detonators (e.g., on 50 millisecond delay). This blast configuration results in throw of the fragmented rock, both laterally toward the burn and upwards into the open stope. Advantageously, the swell into the stope 24 nearly fills the previously open void.

Figure 5:
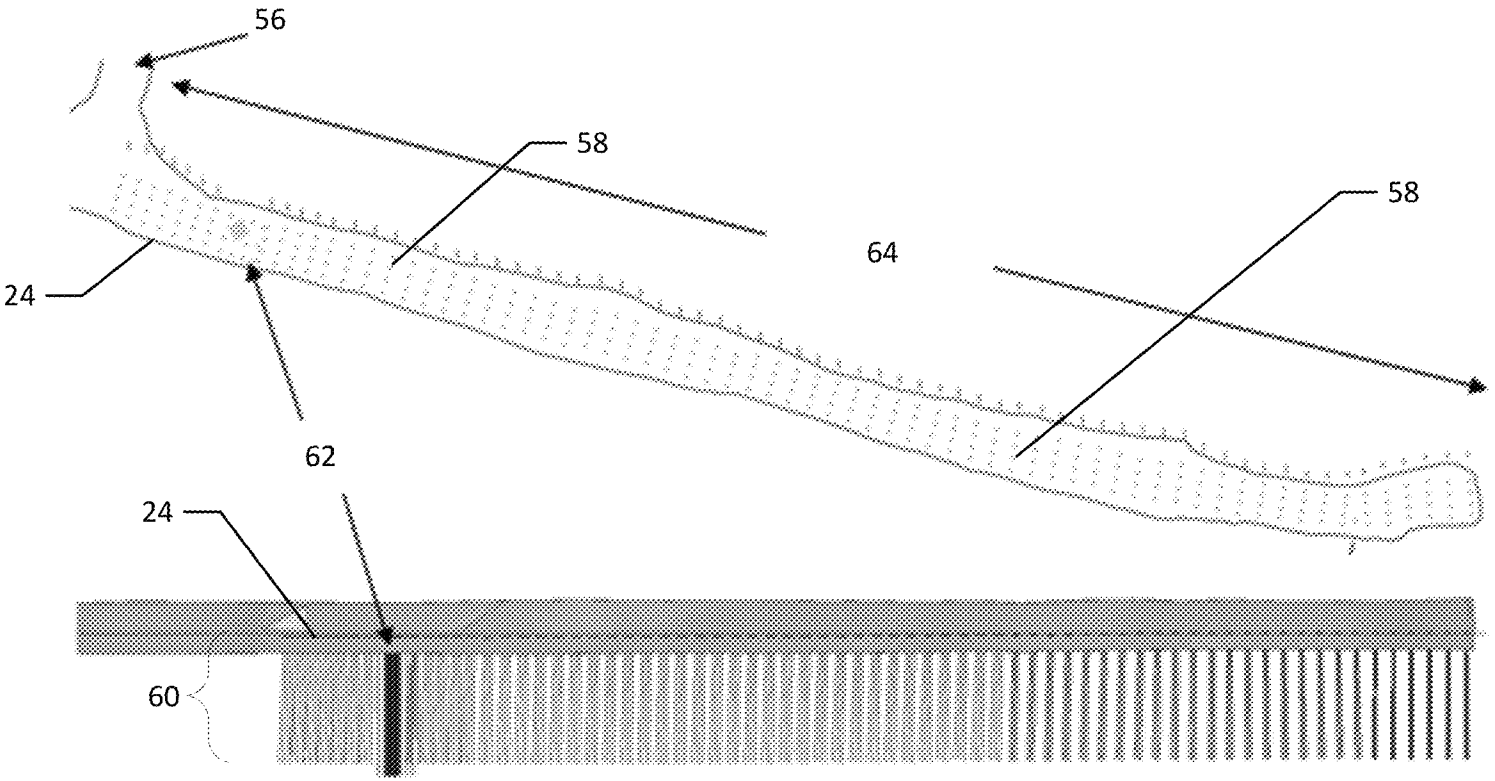
FIG. 5 illustrates top and side views of a typical blast hole ring configuration for underhand closed bench mining.

FIG. 5 illustrates top and side views of a typical blast hole ring configuration for underhand closed bench mining. Specifically, FIG. 5 illustrates a top view of the stope 24 with crosscut access 56 (e.g., from a ramp). Along the stope 24, particularly along the floor of stope 24 as viewed from the top of stope 24, are a plurality of collar locations 58. These collar locations 58 are configured for blast hole rings to be drilled in a desired pattern. For example, blast holes (e.g., 3 inch diameter blast holes) are spaced on 4.5 foot centers within a ring; each ring is spaced 4.5 feet from other rings. The blast holes are loaded with emulsion explosive to within 4 to 6 feet of the hole collar, which is stemmed with pea gravel, achieving a powder factor of 1.75 to 2.25 pounds of explosive per ton of rock. The rings are blasted laterally into the burn section of the blast as well as vertically up into the open stope void.

In an embodiment, these blast holes are 26 feet deep (e.g., the blast holes extend 26 feet into the floor of stope 24). The depth 60 of these blast holes is illustrated by the side view of FIG. 5.

The blast is initiated at the burn cut 62, previously illustrated above with respect to FIG. 4, which creates an initial open void when blasting commences. This initiated blast, via the burn cut 62, is followed by initiating the blast hole rings (e.g., at the collar locations 58) from the burn cut 62 to the end of the stope 24. For example, the blast is initiated along a 350 foot length 64 of the stope 24 starting at the burn cut 62. The blast hole rings along this length 64 are sequentially detonated (e.g., using programmable electronic detonators on 50 millisecond delay). This blast results in a throw of fragmented rock both laterally (e.g., towards the burn cut 62) and upwards (e.g., into the open stope 24). As previously noted, swell into the stope 24 effectively fills the previously open void with blasted material.

Figure 6:
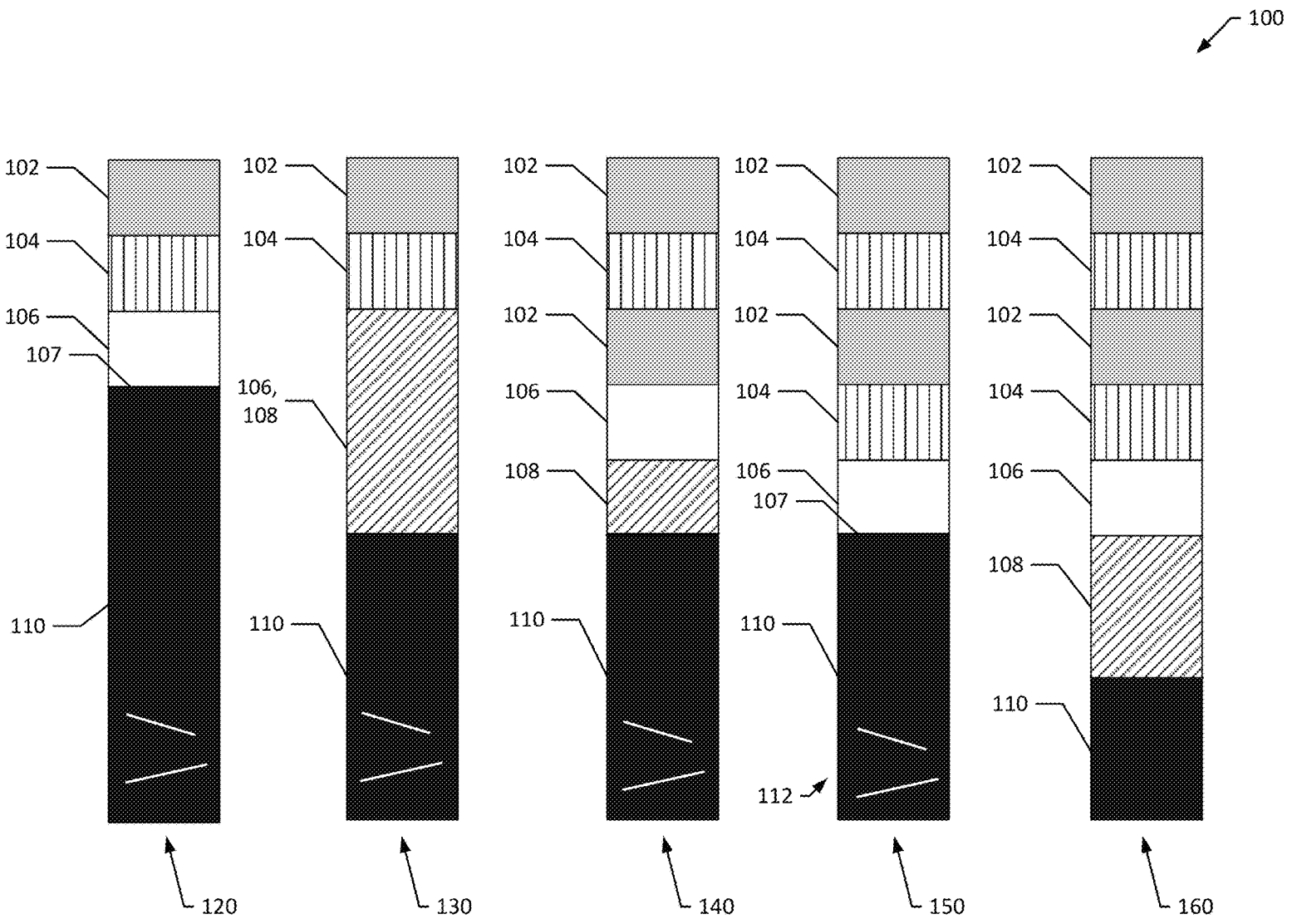
FIG. 6 illustrates a schematic method of underhand closed bench mining, according to an example embodiment of the present disclosure.

FIG. 6 illustrates a schematic method of underhand closed bench mining. The method 100 is a multi-step process, very similar to method 10 disclosed above. Namely, FIG. 6 illustrates five separate stages 120, 130, 140, 150, 160 of method 100. It should be appreciated that method 100 occurs along a length of a horizontal stope. The length of this horizontal stope is not depicted by FIG. 6; rather, FIG. 6 illustrates the cross-sectional view of this horizontal stope. In an example embodiment, the horizontal stope is approximately twelve feet wide. Generally, with FIG. 6, it should be appreciated that the horizontal stope extends, in a generally horizontal direction (e.g., into the page), hundreds or thousands of feet.

Furthermore, the method 100 disclosed herein is specifically designed for deep narrow vein mines. For example, it should be appreciated that the horizontal stope described and illustrated herein is approximately 7,000 feet below the surface of the earth.

As described herein, this horizontal stope is mined in slices. For example, one slice of the horizontal stope is blasted, mined, and stabilized. A subsequent slice of the horizontal stope, which is below the previously mined slice, is then blasted, mined, and stabilized. Therefore, as method 100 is described from first stage 120 to fifth stage 160, mining is being performed in an overall downward direction (e.g., toward the center of the earth) on a slice-by-slice basis. As illustrated in FIG. 6, the mining environment includes a number of slip on faults 112 within ore 110; as described in greater detail herein, these slip on faults 112 are seismically triggered during blasting via the disclosed method 100.

Starting off with the first stage 120, the horizontal stope 106 may include fill material 102, which may include finely-ground mill tailings mixed with cement and/or slag. In an embodiment, the section of fill material 102 is approximately ten feet high. It should be appreciated that additional fill material 102 and/or natural earthen material may be disposed further above the embodiment illustrated herein.

Below the fill material 102 is a first engineered ceiling 104. In an embodiment, the engineered ceiling 104 is approximately ten feet high. This first engineered ceiling 104 is configured to retain fill material 102, along with anything above fill material 102, from collapsing down into stope 106. Engineered ceiling 104 generally stabilizes stope 106. For example, engineered ceiling 104 may include cemented and reinforced fill material 102.

Stope 106 is an open void, configured for blasting and recovery of ore. Namely, mining personnel will access stope 106, drill one or more holes into a surface of stope 106, and blast explosives into the surface of stope 106. The post-blasted material is recovered from within stope 106, and subsequently processed underground or above the surface.

Whereas prior techniques involved drilling blast holes along the horizontal face of stope 106, the claimed method 100 employs a different technique. Namely, via the underhand closed bench method 100 disclosed herein, mining personnel will drill a plurality of blast holes downward along a length of the stope 106. In a particular embodiment, the blast holes are drilled along a bottom surface or floor 107 of the length of the stope 106 (e.g., the floor of stope 106).

As noted previously, with respect to FIG. 4, the blast holes can be drilled in a number of different patterns and configurations, all of which are contemplated herein.

Continuing on with method 100 of FIG. 6, once the particular hole pattern is drilled into the floor 107 of stope 106, explosives are inserted into the hole pattern. For example, the blast holes are injected with pumpable emulsion explosives. The explosives are subsequently detonated. As noted, in an embodiment, this blasting employs electronic detonators to ensure that an entire length of stope 106 (e.g., a three-hundred foot strike length) is fragmented into blast material 108 in one simultaneous blast. Though the blast is confined to stope 106, it is configured to fragment blast material 108.

Because the blast holes are drilled along the floor 107 of stope 106, blasting occurs in a downward direction (e.g., towards ore 110). In a particular embodiment, by blasting in a downward direction, with sufficient blast magnitude, method 100 intentionally triggers one or more localized seismic in the downward direction (e.g., below stope 106) due to slip on faults beneath the floor of stope 106. For example, blasting proactively triggers these slip on faults below the stope 106, reducing risk of stope collapse. Further, blasting proactively triggers these slip on faults during blasting times, when no mining personnel are present. Additionally, fragmented ore that remains post-blast provides structural support to the walls of stope 106, minimizing any ancillary damage caused from an induced seismic event.

As illustrated by second stage 130, once blasting has occurred, the stope 106 is commingled with blast material 108. For example, across the entire blast length of stope 106 (e.g., a three-hundred foot strike length), material 108 is blasted thirty feet deep below stope 106. Mining personnel will then recover fragmented ore (e.g., via front-end loaders) from stope 106. This procedure, generally referred to as mucking, may further include supporting the excavated stope 106 with wire mesh and rock bolts. The recovered fragmented ore is processed under the earth or sent above-ground for further processing.

Crushed and milled waste material (tailings) mixed with cement is then used to backfill the stope 106. For example, third stage 140 and fourth stage 150 of method 100 illustrate that fill material 102 is positioned above stope 106, and is retained above stope 106 via a second engineered ceiling 104. As fill material 102 and second engineered ceiling 104 are installed above stope 106, stope 106 generally moves in a downward direction (e.g., toward ore 110).

At this point in the method 100, fourth stage 150 and fifth stage 160 illustrate a repetition of the process discussed above. Namely, mining personnel will drill a plurality of blast holes along a length of the stope 106, such as the floor 107 of the length of the stope 106 (e.g., the floor of stope 106). Once the particular hole pattern is drilled into the floor 107 of stope 106, explosives are inserted into the hole pattern. The explosives are subsequently detonated. Though the blast is confined to stope 106, it is configured to fragment ore 110 into blast material 108. Furthermore, the blast intentionally triggers one or more localized seismic in the downward direction (e.g., below stope 106), such as slip on faults below the stope 106. As an example, fourth stage 150 illustrates several slip on faults 112 within ore 110; these slip on faults 112 are seismically triggered during blasting, and thus are no longer a risk at fifth stage 160 (post-blasting).

Once blasting has occurred, the stope 106 is commingled with blast material 108. Mining personnel will then recover fragmented ore from stope 106. Fill material 102 may be positioned above stope 106, and retained above stope 106 via an engineered ceiling (not illustrated). Again, horizontal stope 106 generally moves in a downward direction (e.g., toward ore 110) as the method 100 repeats until no more ore 110 is recoverable.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

As used in this specification, including the claims, the term "and/or" is a conjunction that is either inclusive or exclusive. Accordingly, the term "and/or" either signifies the presence of two or more things in a group or signifies that one selection may be made from a group of alternatives. As used here, "at least one of," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Without further elaboration, it is believed that one skilled in the art can use the preceding description to utilize the claimed inventions to their fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles discussed. In other words, various modifications and improvements of the embodiments specifically disclosed in the description above are within the scope of the appended claims. For example, any suitable combination of features of the various embodiments described is contemplated.

Note that elements recited in means-plus-function format are intended to be construed in accordance with 35 U.S.C. § 112 ¶6. The scope of the invention is therefore defined by the following claims.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

The invention is claimed as follows:

1. A method of mining, comprising:

drilling a first plurality of blast holes along a length of a horizontal stope;

blasting explosive within the first plurality of blast holes;

recovering fragmented ore from the horizontal stope;

stabilizing the horizontal stope via a first engineered roof;

drilling a second plurality of blast holes along the length of the horizontal stope;

blasting explosive within the second plurality of blast holes;

recovering fragmented ore from the horizontal stope; and stabilizing the horizontal stope via a second engineered roof, such that the horizontal stope is mined in a downward direction, wherein the explosive is sufficient to cause a seismic event in the downward direction.

2. The method of claim 1, wherein each of the first plurality of blast holes and the second plurality of blast holes are disposed on a floor of the horizontal stope.

3. The method of claim 1, wherein the first engineered roof includes backfill material.

4. The method of claim 1, wherein the first plurality of blast holes and the second plurality of blast holes are injected with pumpable emulsion explosives.

5. The method of claim 1, wherein the first plurality of blast holes are patterned in a square configuration.

6. The method of claim 5, wherein the square configuration includes nine blast holes and eight dead holes.

7. The method of claim 1, wherein the length of the horizontal stope is fragmented in one simultaneous blast.

8. The method of claim 1, wherein the length of the horizontal stope is approximately three hundred feet.

9. A method of mining, comprising:

drilling a first plurality of blast holes along a length of a horizontal stope, wherein at least one slip-on fault is disposed under the horizontal stope;

blasting explosive within the first plurality of blast holes;

recovering fragmented ore from the horizontal stope;

drilling a second plurality of blast holes along the length of the horizontal stope;

blasting explosive within the second plurality of blast holes;

recovering fragmented ore from the horizontal stope, such that the horizontal stope is mined in a downward direction, wherein the explosive is sufficient to cause a seismic event at the slip-on fault.

10. The method of claim 9, wherein each of the first plurality of blast holes and the second plurality of blast holes are disposed on a floor of the horizontal stope.

11. The method of claim 10, wherein the first plurality of blast holes are drilled at a first starting depth, wherein the second plurality of blast holes are drilled at a second starting depth, and wherein the first starting depth is at least twenty feet above the second starting depth.

12. The method of claim 9, wherein the first plurality of blast holes and the second plurality of blast holes are injected with pumpable emulsion explosives.

13. The method of claim 9, wherein the first plurality of blast holes are patterned in a square configuration.

14. The method of claim 13, wherein the square configuration includes nine blast holes and eight dead holes.

15. The method of claim 9, wherein the length of the horizontal stope is fragmented in one simultaneous blast.

16. The method of claim 9, wherein the length of the horizontal stope is approximately three hundred feet.

17. The method of claim 9, wherein a depth of the first plurality of blast holes is approximately 26 feet deep.

18. The method of claim 9, wherein the first plurality of blast holes includes a burn cut and a plurality of patterned blast hole rings.

* * * * *